United States Patent [19]

Mozer

[11] Patent Number: 4,625,438

[45] Date of Patent: Dec. 2, 1986

[54] EXCAVATING BUCKET HAVING POWER DRIVEN, INDIVIDUALLY CONTROLLED DIGGING TEETH

[76] Inventor: Daniel S. Mozer, 126 Grandview Ave., Yardville Heights, N.J. 08620

[21] Appl. No.: 777,996

[22] Filed: Sep. 20, 1985

[51] Int. Cl.[4] ..... E02F 5/00

[52] U.S. Cl. ..... 37/141 T; 37/103; 37/117.5; 37/DIG. 18

[58] Field of Search ..... 37/103, DIG. 18, 141 R, 37/141 T, 142 A, 142 R, 117.5; 299/94, 67, 70

[56] References Cited

U.S. PATENT DOCUMENTS

| | | | |
|---|---|---|---|
| 2,228,445 | 1/1941 | De Velbiss | 37/DIG. 18 |
| 3,065,557 | 11/1962 | Pewthers | 37/DIG. 18 |
| 3,305,953 | 2/1967 | Von Mehren et al. | 37/DIG. 18 |
| 3,550,960 | 12/1970 | Holder | 37/142 R |
| 3,565,182 | 2/1971 | Teasdale | 37/142 R |
| 3,659,654 | 5/1972 | Davies et al. | 37/142 X |
| 3,677,604 | 7/1972 | Leyrat | 37/DIG. 18 |
| 3,828,951 | 8/1974 | Fleming | 37/DIG. 18 |
| 3,864,852 | 2/1975 | Lochrie | 37/141 R |

FOREIGN PATENT DOCUMENTS

| | | | |
|---|---|---|---|
| 972397 | 8/1975 | Canada | 37/141 T |
| 2044059 | 7/1980 | Fed. Rep. of Germany | 37/141 T |
| 1180062 | 2/1970 | United Kingdom | 37/141 T |

*Primary Examiner*—E. H. Eickholt
*Attorney, Agent, or Firm*—Sperry, Zoda & Kane

[57] ABSTRACT

An excavating bucket, for example a bucket of the type used on a backhoe, has a leading or digging edge along which is provided a row of individually pneumatically driven digging teeth. Power for the teeth is supplied through impact hammers which reciprocate the teeth at high speed and with great force, whereby the teeth may be advanced into a work surface and break it up for loading into the bucket with maximum speed and ease. As high speed reciprocation of the several teeth continues, their associated impact hammers are progressively, relatively slowly advanced bodily toward the work surface, so as to effect a steady and substantially continuous penetration of the surface, including cementitious surfaces and other very hard surfaces often encountered during excavation, demolition, and other heavy operations in which a backhoe is typically used. As progressive advancement of the hammer persists under pressure from pistons advanced against the hammers by air under pressure, arms on the hammers engage valves that control the flow of air under pressure to the hammers, thereby causing cessation of the operation of each hammer when it has been advanced a predetermined distance through the work. Further movement of the backhoe bucket into the work thereafter causes retraction of the hammers, once again permitting air under pressure to be supplied thereto, and also initiating a new cycle of advancement under the pressure of the pistons, for each of the several, individually powered units.

15 Claims, 5 Drawing Figures

EXCAVATING BUCKET HAVING POWER DRIVEN, INDIVIDUALLY CONTROLLED DIGGING TEETH

BACKGROUND OF THE INVENTION

1. Field of the Invention

The present invention relates generally to excavating equipment, and in a more particular sense has reference to a backhoe bucket, having on its leading or digging edge a series of digging tooth units, each of which is power driven, and each of which is further individually controlled with respect to the air supplied thereto and its advancement toward a work surface that is to be broken up and loaded into the bucket.

2. Description of the Prior Art

Heretofore, it has been proposed to provide a backhoe bucket or similar excavating device, having a row of power driven digging teeth.

The prior art suggests the provision of pneumatically powered teeth reciprocated at high speed, as for example by an air hammer. In such devices, the advancement of the teeth into the work surface has resulted entirely from the bodily movement of the backhoe bucket toward said work surface. This has produced disadvantages, in that some or all of the digging teeth may encounter surfaces too hard to be broken up when the entire series of teeth are simply forced against the work by the pressure of the bucket alone.

The prior art, thus, has been deficient in respect to efficiently controlling the advancement of each tooth, independently of the other teeth, into the work surface, in a manner whereby exceptionally hard material encountered by one tooth will not detract from the ability of the other teeth to continue advancement into the surface that is being broken up and removed. And, the prior art has included no provision whereby one or more teeth that may be encountering unusually heavy resistance to penetration, will be advanced into the work at a rate of speed that will assure breaking up of the work surface thereby in the shortest period of time and with the maximum efficiency.

Another characteristic of prior art machines may be noted, in that machines of this type have not been energy-efficient. In those machines in which there are individually powered digging teeth, all the teeth continue in operation whether or not resistance is being encountered thereby. As a result, the output of compressed air to the teeth has been maintained at an undesirable, maximum level. This points up the obvious desirability of providing a machine of this type in which the use of compressed air is kept to a minimum, and is permitted to occur only when the compressed air is being utilized to advantage.

In similar devices in the prior art, further, the digging tooth assemblies have been placed under undesirable strain, in that no special provision has been made to protect the digging teeth when they are not being reciprocated by their associated air hammers. It is accordingly desirable to overcome this deficiency of the prior art by incorporating means which will automatically shift the teeth to retracted positions when power to their associated air hammers is cut off.

It is proposed, in carrying out the present invention, to overcome the noted prior art deficiencies, through the provision of a backhoe bucket having pneumatically powered teeth each of which, while being reciprocated at high speed by an associated impact hammer, will at the same time be moved forward continuously into the work independently of the other teeth.

It is further proposed to assure economy of operation to the maximum extent, through the provision of means that will cut off the supply of air to each individual tooth unit, whenever reciprocation of the tooth is unnecessary or undesirable, while assuring continued operation of those teeth in which high speed reciprocation remains productive.

Further, it is proposed to overcome the deficiencies of the prior art by incorporating means in each tooth unit which will retract the tooth automatically whenever power to the unit is cut off, thus permitting the bucket to operate as a conventional bucket of the type in which the teeth are permanently and immovably mounted adjacent the digging edge of the bucket.

SUMMARY OF THE INVENTION

Summarized briefly, the present invention incorporates, in an otherwise conventional digging and loading bucket mounted upon the balance beam of a backhoe or other excavating machine, a row of tooth assemblies or digging units, all of which are identically formed, but are power driven independently of one another.

Each unit includes an air hammer, adapted to reciprocate a digging tooth at high speed. The air hammers are provided with compressed air from a common source, through a manifold from which lines extend to the respective hammers. Each unit further includes a piston and a piston chamber located at the rear of the impact hammer. Air under pressure is directed into these several piston chambers, through a manifold common to the several chambers. The air under pressure directed into the several piston chambers may be supplied from the same source as that used to supply air to the impact hammers.

The pistons exert a continuous pressure upon the impact hammers, opposed by compression springs bearing against the leading ends of the hammers. As a result, while the hammers are reciprocating the digging teeth at high speed, they are being continuously advanced toward the work surface, with the impact hammer of each unit being so advanced independently of the hammers of the remaining units.

In the event any tooth encounters excessive resistance, its forward movement under the pressure of the associated piston may be slowed or halted, but this does not affect the forward movement into the work of those units which are not encountering similar resistance.

When each hammer has been advanced a predetermined distance, an arm extending laterally therefrom engages and closes a valve through which air is supplied to the hammer. As a result, the hammer stops operation. The entire bucket may now be moved forwardly, pushing the hammers back against the pressure exerted thereon by the pistons, so as to once again initiate operation of the impact hammers and the advancement thereof through the work under the pressure of the pistons.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DESCRIPTION OF THE PREFERRED EMBODIMENT

Figure 2:
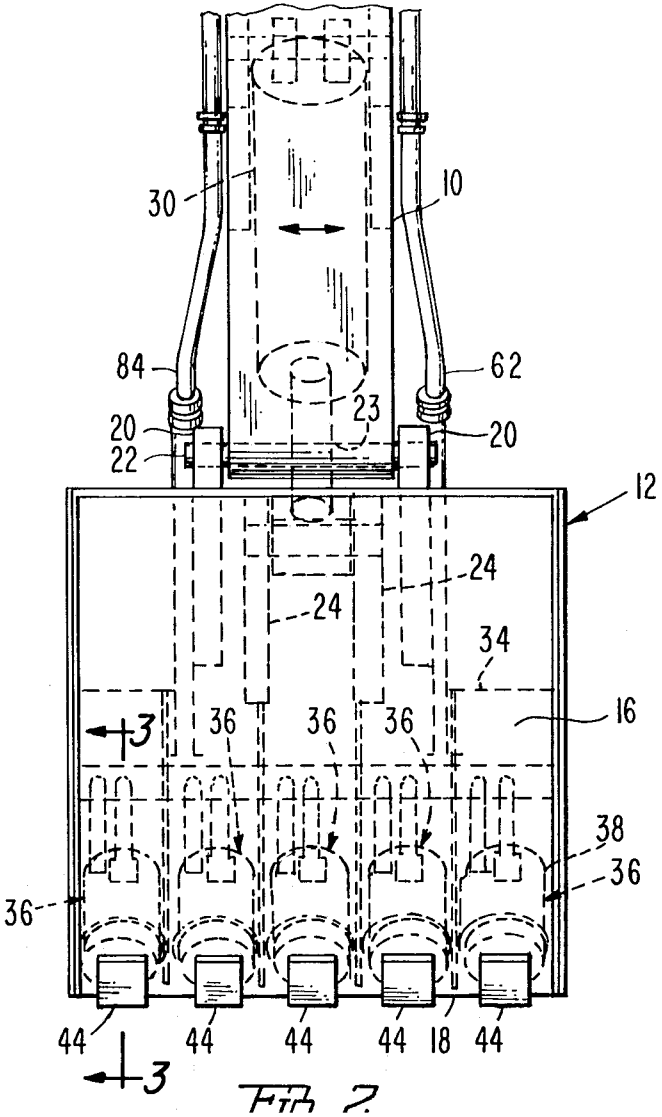
FIG. 2 is a front elevational view of the bucket.

The reference numeral 10 has been used to designate the balance beam, stick or arm of a conventional backhoe or other earth-working machine.

The bucket includes a pair of vertical side walls 14 rigidly connected to a body portion 16 in the form of a continuously curved plate forming (see FIG. 1) the top, back, and bottom wall of the bucket. The bucket is completely open at its front, and is provided with a sharpened or beveled digging lip 18 along the bottom edge of the body portion. To this extent, the bucket 12 is of conventional formation. Further, it is mounted in a conventional manner, having upwardly projecting, transversely spaced mounting flanges 20 welded or otherwise rigidly secured to the body portion 16 at the upper end of the bucket. Flanges 20 are formed with transversely aligned bearing openings receiving the opposite ends of a hinge pin 22, which extends through a transverse bore 23 provided in the lower end of a conventional balance beam or stick 10. The balance beam, typically, is pivotally mounted for swinging movement and up and down movement in the direction of the arrows shown in FIG. 1, and may also be shifted transversely as shown by the direction arrows in FIG. 2. The bucket may be mounted in the same manner, for example, as in Re. Pat. No. 30,769 issued to Cobb et al, the disclosure of which is incorporated by reference in the present application for this purpose.

Transversely spaced mounting flanges 24 extending from the back of the bucket receive a pivot pin 26, extending through the lower end of a ram 28 of a hydraulic cylinder 30, the upper end of which is pivotally connected at 32 to the balance beam 10.

The construction so far described is completely conventional and does not in and of itself constitute part of the present invention.

Figure 1:
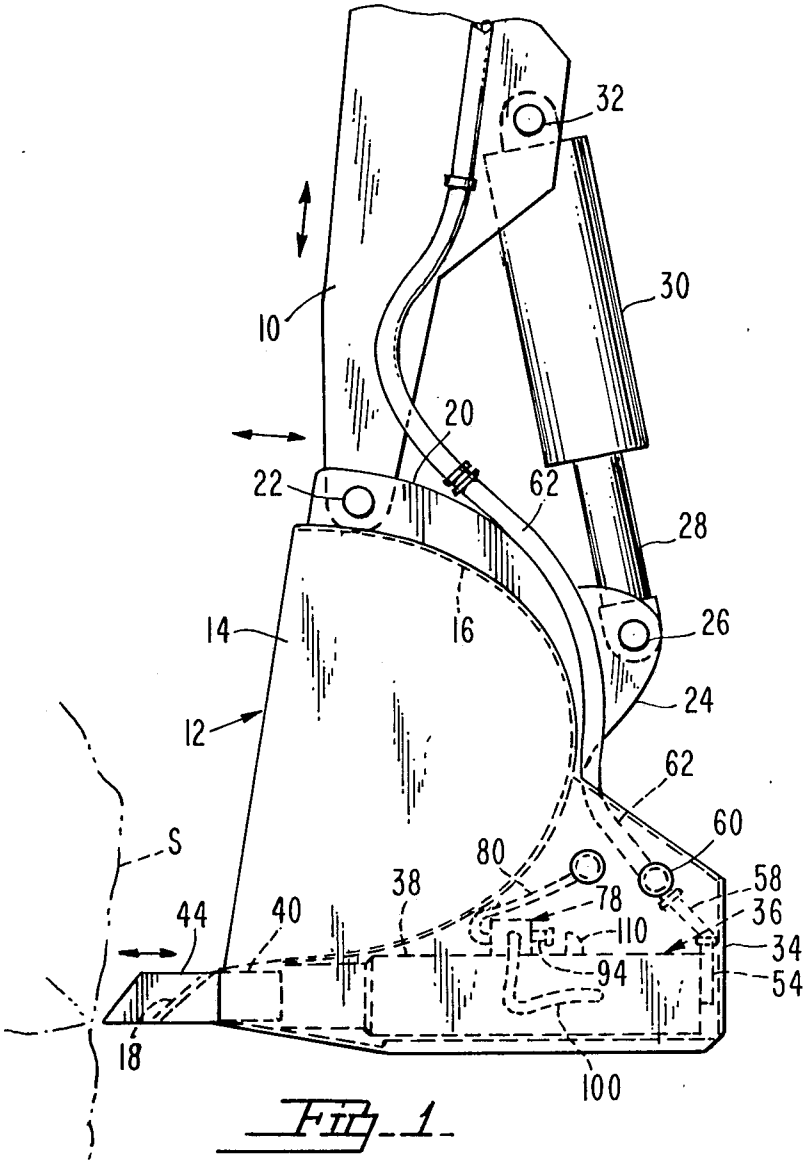
FIG. 1 is a side elevational view of a backhoe bucket equipped with digging units or tooth assemblies constructed according to the present invention, a work surface being shown fragmentarily and in dotted outline, the beam structure on which the bucket is mounted being illustrated fragmentarily.

In accordance with the present invention, there is provided a housing 34 extending the full width of the bucket, and rigidly secured to the body portion 16 thereof. The housing extends rearwardly and downwardly from the body portion 16, as shown in FIG. 1, and is adapted to protectively enclose an array of tooth assemblies or digging units generally designated 36 (see FIG. 2) mounted in the housing in side-by-side, closely spaced, parallel relation. All the units are identical, and accordingly, the description of one will suffice for all.

Figure 3:
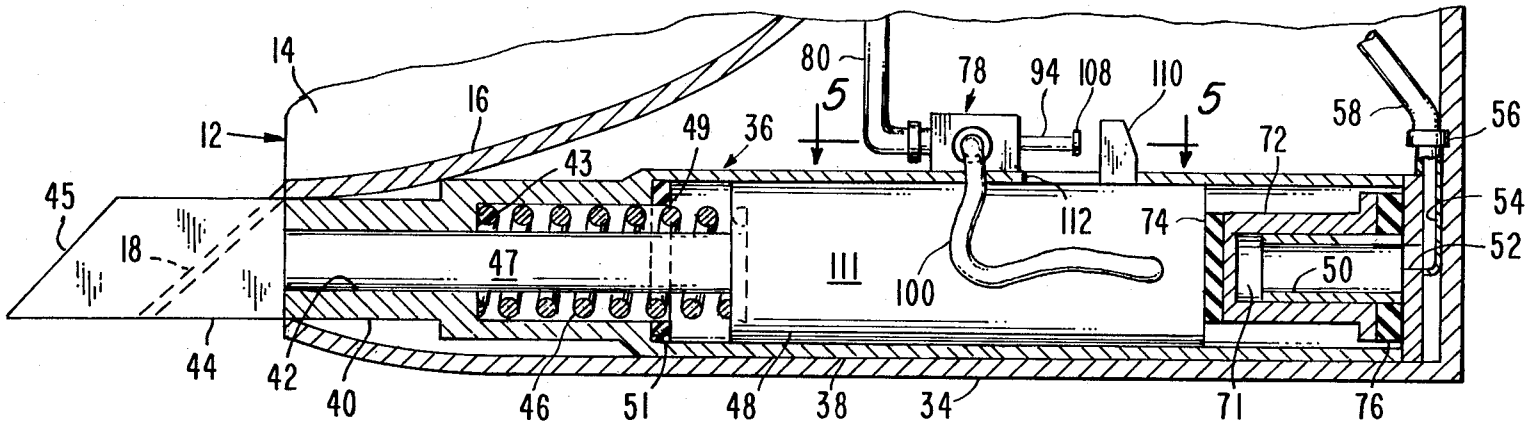
FIG. 3 is an enlarged sectional view taken substantially on line 3—3 of FIG. 2, illustrating one of the digging units in longitudinal section.

Each of the units 36 is provided, as best shown in FIG. 3, with an elongated, cylindrical casing 38, the front end of which is stepped down as shown at 40 to a reduced diameter, and is formed with an elongated, axial bore 42. A digging tooth 44, having a beveled front end 45, is fixedly mounted upon the front end of a shaft 47 slidable in bore 42 and constituting the axially reciprocable component of an impact hammer 48 of the type driven by compressed air. Hammer 48, in and of itself, is of a conventional construction, and is well known. Such hammers include, basically, an internal piston mechanism which is adapted to be reciprocated at high speed when compressed air is forced into the casing, as a result of which the shaft 47 thereof, which is connected to the piston mechanism, is correspondingly reciprocated. Impact or air hammers of this type, also known as jack hammers, are well known in the art and accordingly description of the internal mechanism thereof is unnecessary.

Within casing 38, an internal shoulder 51 is provided, against which seats an annular rubber cushion 49. Extending through the cushion is a compression coil spring 46, one end which bears against a shoulder 43, the other end bearing against the forward end of the housing of the jack hammer 48.

Spring 46, seeking to expand, tends to urge the housing of the jack hammer rearwardly within the casing 38, to the position shown in FIG. 3.

A space is provided between the rear end of casing 38 and the jack hammer 48, and within this space there is mounted a guide sleeve 50 which is fixedly, permanently secured to the back wall of casing 38. The guide sleeve, at its rear end, is in communication with an inlet port 52, communicating with an inlet tube 54 secured to the casing 38. Coupled to tube 54 by means of coupling 56 is an air inlet hose 58, extending from a manifold 60 (FIGS. 1 and 4) which is common to the several digging units, there being a line 58 from the manifold 60 to each individual unit.

Air is supplied to the manifold 60 through an air line 62. Line 62 extends from a source of compressed air (see FIG. 4), and may be provided with any conventional mechanisms utilized in compressed air systems, such as compressed air storage tank 64 in which there is a continuous supply of air under pressure, a main on-off valve 66, regulator 68, and bleeder valve 70.

Air supplied through the line 58 extending to each digging unit 36, enters a piston chamber 71 through sleeve 50, exerting pressure against a cup-shaped piston 72 slidably mounted upon the sleeve 50. A rubber cushion 74 is secured to the front end of piston 72, and bears against the rear wall of the jack hammer 48.

It is further desirable to provide, on the flanged rear end of the piston 72, an annular gasket 76, which prevents leakage from the piston chamber 71.

Figure 4:
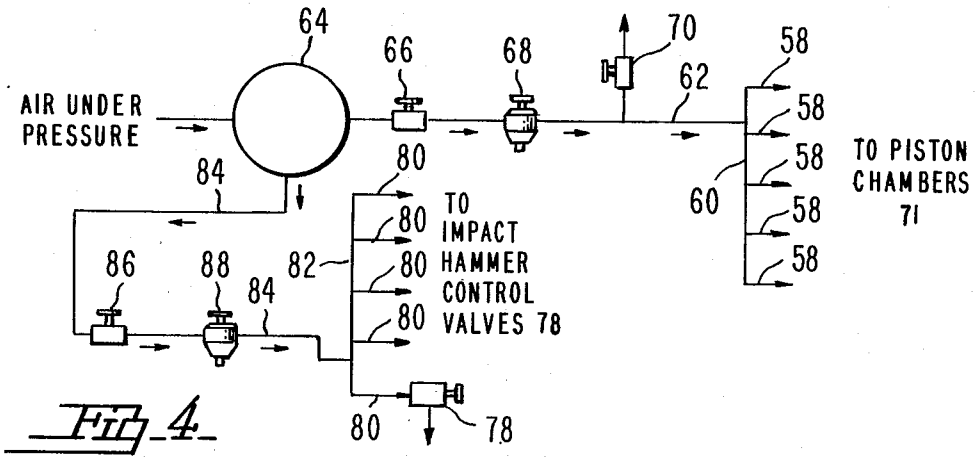
FIG. 4 is a schematic view illustrating the air supply system provided for the several tooth units.

Mounted upon each casing 38 is a control valve assembly 78. The detailed construction of each assembly 78 is illustrated to particular advantage in FIG. 5, and it is there shown that an air line 80 extends to the inlet end of the valve assembly, from (see FIG. 4) a manifold 82 common to the several digging units. Air is supplied to manifold 82 (see FIGS. 2 and 4), through a line 84 extending from the storage tank 64. There can be provided, as shown in FIG. 4, any conventional mechanisms for regulating, bleeding off, or turning the air supply on and off from a remote location, such as the on-off valve 86, regulator 88 and if necessary a bleeder valve, not shown.

Figure 5:
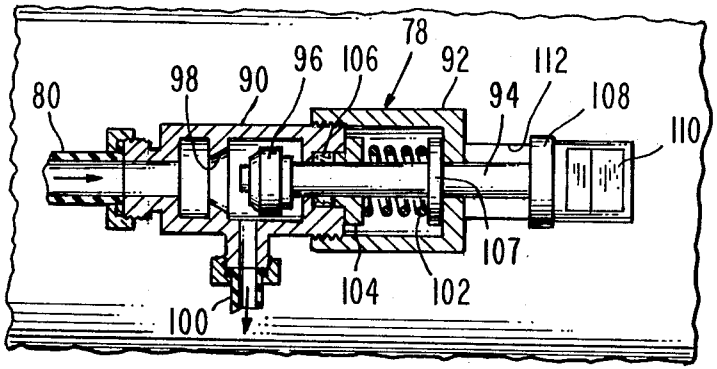
FIG. 5 is an enlarged sectional view through one of the impact hammer control valve assemblies taken substantially on line 5—5 of FIG. 3.

Air supplied to power each jack hammer enters the associated valve control assembly 78 through the inlet line 80, entering a two-part valve housing that includes an air flow chamber 90, and a valve stem guide chamber 92, these components of the housing being threadedly connected as shown in FIG. 5. Within chamber 92, a stem 94 is axially slidable, which within the float chamber is provided with a valve head 96 adapted to engage seat 98. When the valve is open as shown in FIG. 5, air flows into the flow chamber 90 through inlet tube 80, and exits through a connecting tube 100 (see FIG. 3), through which the air flows into the jack hammer for powering the same.

Within the valve stem guide chamber 92, there is provided a compression spring 102, extending about the valve stem, and bearing at one end against a fitting 104 provided with packing 106, to prevent leakage of air from the flow chamber 90 into the guide chamber 92. The spring at its other end bears against a collar 107 provided upon the valve stem.

The valve stem extends out of the guide chamber 92, and exteriorly of said chamber is provided with a head 108, disposed in position to be engaged by a lateral arm 110 projecting from the housing 111 of the impact hammer. A slot 112 is formed in casing 38 to permit movement of the arm 110 as the impact hammer moves forwardly toward the work surface S.

OPERATION

In use of the invention, let it be assumed that the bucket is being utilized to break up and remove a work surface S. Relatively soft materials do not, of course, present any problem, and in these circumstances the bucket can be used without activation of the impact hammers 48.

If, however, the surface S is, to state an example, a concrete wall, or is composed wholly or in part of heavy shale or rocks of substantial size, it then becomes advisable to put the impact hammers into operation. The bucket is advanced to the position shown in FIG. 1, and air under pressure is directed through the lines 62, 84, to the manifolds 60, 82, respectively.

This causes the teeth 44 to be reciprocated at high speed, thereby effectively breaking up the work surface S. At the same time, with the bucket now stationary in the FIG. 1 position, the air under pressure directed into the several piston chambers 71 causes the pistons 72 to be progressively advanced against the resistance of the springs 46 and the work surface itself. The advancement of each piston 72 is independent of that of any other piston, and proceeds in direct relation to the resistance encountered by the tooth 44 of the same digging unit 36.

Each tooth 44, while being reciprocated at high speed, is being steadily, bodily advanced into the work surface.

As each tooth is moved forwardly in this manner under the pressure of its associated piston 72, ultimately the arm 110 of the housing 111 of its associated impact hammer 48 will engage the head 108 of valve stem 94. The further forward movement of the tooth causes the valve stem to be forced inwardly, to seat the valve head 96 and thereby shut off flow of air to the impact hammer.

At substantially the same time, the forward end of the impact hammer casing or housing 111 engages cushion 49.

It may be noted that this may occur more rapidly in one digging unit than in another. Each digging unit is powered independently of the others. In any event, under normal circumstances ultimately all of the impact hammers will cease operation as the several teeth penetrate the work to the maximum extent permitted by the forward travel of the pistons and impact hammers.

At this time, the entire bucket is moved forwardly again. As a result, the area of the work surface that has not been penetrated places such resistance on the teeth, as to cause them to be forced rearwardly relative to the advancing bucket. The impact hammers 111, and the pistons 72, are correspondingly forced rearwardly.

The result of the rearward movement of the teeth, impact hammers and pistons is to once again permit air to be directed to the several impact hammers, since the rearward movement of the impact hammers also moves the arms 110 rearwardly, permitting the valves 78 to open.

The cycle is now repeated, that is, the several teeth are reciprocated at high speed, and the pistons 72 are at the same time moving forward to advance the impact hammers and the teeth as the teeth further break up and penetrate the surface S.

It will be understood that whenever sufficient material has been broken up, it is loaded into the bucket and removed, and the bucket is thereafter repositioned to permit the digging units to attack a fresh, unbroken area of surface S.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. In a power-driven digging and loading bucket of the type mounted on a balance beam of a piece of heavy-duty construction equipment, said bucket having a leading edge, the improvement that comprises:

(a) a row of digging units mounted on said leading edge, each of which includes
  (1) a digging tooth projecting beyond said leading edge in position to strike and break up a work surface,
  (2) a hollow casing fixedly mounted in said bucket,
  (3) pneumatic hammer means for imparting high-speed reciprocating movement to said tooth, said hammer means including an impact hammer housing slidably mounted in the casing for advancement bodily toward said work surface with the tooth during said reciprocating movement of the tooth, and
  (4) means for advancing said tooth and the housing of its associated hammer means bodily toward said surface;

(b) means for directing air under pressure into the several hammer means from a source common to all of said units; and (c) means for shutting off the supply of air under pressure to each hammer means independently of the other hammer means responsive to bodily advancement of its housing through a predetermined distance.

2. The improvement of claim 1 wherein the means for directing air under pressure to the several digging units includes a manifold and a plurality of lines leading therefrom to said units.

3. The improvement of claim 1 wherein each of said units further includes means resiliently, yieldably opposing the advancement of the tooth and the housing of the hammer means thereof.

4. The improvement of claim 1 wherein said advancing means includes a pressure fluid system adapted to direct a pressure fluid to each unit for exerting a continuous pressure against the housing of the hammer means tending to advance said housing bodily toward the work surface.

5. The improvement of claim 4 in which said advancing means further includes a piston bearing against the housing of the impact hammer in position to be forced thereagainst by said pressure fluid to cause said advancement of the housing.

6. The improvement of claim 5, further including a piston chamber into which the pressure fluid is directed for forcing the piston against the housing of the hammer means for bodily advancing the same toward said surface.

7. The improvement of claim 6 wherein said pressure fluid system is common to all the units.

8. The improvement of claim 7 wherein the pressure fluid system includes a manifold from which pressure fluid lines extend to the piston chambers of the several units.

9. The improvement of claim 8 wherein the pressure fluid is compressed air.

10. In a power-driven digging and loading bucket of the type mounted on a balance beam of a piece of heavy-duty construction equipment, said bucket having a leading edge, the improvement that comprises:

(a) a row of digging units mounted on said leading edge, each of which includes
  (1) a digging tooth projecting beyond said leading edge in position to strike and break up a work surface,
  (2) pneumatic hammer means for imparting high-speed reciprocating movement to said tooth, and
  (3) means for advancing said tooth and its associated hammer means bodily toward said surface; and (b) means for directing air under pressure into the several hammer means from a source common to all of said units, each of said units further including means resiliently, yieldably opposing the advancement of the tooth and hammer means thereof, each unit further including means for deactivating the hammer means thereof when the same has been advanced a predetermined distance, said deactivating means being operable to cut off the supply of air to said unit, the deactivating means of each unit being operable independently of the corresponding means of the several remaining units, the deactivating means of each unit including a normally open shut-off means arranged to cut off the supply of air under pressure to the hammer means thereof, said deactivating means further including means on the hammer means arranged to engage and close said valve means responsive to advancement of the hammer means over said predetermined distance.

11. In a power-driven digging and loading bucket of the type mounted on a balance beam of a piece of heavy-duty construction equipment, said bucket having a leading edge, the improvement that comprises:

(a) a row of digging units mounted on said leading edge, each of which includes
  (1) a digging tooth projecting beyond said leading edge in position to strike and break up a work surface,
  (2) a casing fixedly mounted in said bucket and in which said tooth is slidably reciprocably mounted,
  (3) pneumatic hammer means for imparting high speed reciprocating motion to said tooth, said means including an impact hammer housing slidably mounted in the casing, said tooth being carried by the housing for reciprocable movement while being bodily slidable toward said work surface with the housing,
  (4) piston means bearing against the housing of the hammer means for progressively advancing the hammer means and the tooth associated therewith toward the work surface over a predetermined distance,
  (5) valve means controlling the operation of said hammer means, and
  (6) means responding to the advancement of the hammer means over said distance for actuating the valve means to stop operation of the hammer means; and (b) a compressed air system common to all of said units for supplying air under pressure to the several hammer means and advancing means.

12. The improvement of claim 11 wherein said system includes first and second compressed air supply lines leading to the several hammer means and to the several advancing means, respectively.

13. In a power-driven digging and loading bucket of the type mounted on a balance beam of a piece of heavy-duty construction equipment, said bucket having a leading edge, the improvement that comprises:

(a) a row of digging units mounted on said leading edge, each of which includes
  (1) a digging tooth projecting beyond said leading edge in position to strike and break up a work surface,
  (2) pneumatic hammer means for imparting high speed reciprocating motion to said tooth,
  (3) piston means bearing against the hammer means for progressively advancing the hammer means and the tooth associated therewith toward the work surface,
  (4) valve means controlling the operation of said hammer means, and
  (5) means responding to the advancement of the hammer means over said distance for actuating the valve means to stop operation of the hammer means; and (b) a compressed air system common to all of said units for supplying air under pressure to the several hammer means and advancing means, said system including first and second compressed air supply lines leading to the several hammer means and to the several advancing means, respectively, said system further including first and second manifolds communicating with the first and second lines respectively and adapted for directing air under pressure to each of the hammer means and advancing means individually.

14. The improvement of claim 13 wherein the advancing means of each unit includes a piston engaging the hammer means for exerting a continuous pressure thereon, and a piston chamber receiving air under pressure through said system for forcing the piston against the hammer means.

15. The improvement of claim 14 in which each unit further includes an arm on each hammer means adapted to engage the valve means, and shut off the supply of air under pressure to the hammer means, when the hammer means has been advanced over said predetermined distance.

* * * * *